US005393141A

United States Patent [19]

Bornemann

[11] Patent Number: 5,393,141

[45] Date of Patent: Feb. 28, 1995

[54] METHOD FOR OPERATING COOLING MIXER FOR BULK MATERIAL IN POWDER AND GRANULAR FORM

[75] Inventor: Hans-Joachim Bornemann, Vellmar, Germany

[73] Assignee: Thyssen Industrie AG, Essen, Germany

[21] Appl. No.: 119,311

[22] Filed: Sep. 8, 1993

Related U.S. Application Data

[63] Continuation-in-part of Ser. No. 894,723, Jun. 4, 1992, abandoned.

[30] Foreign Application Priority Data

Jun. 10, 1991 [DE] Germany ..... 4119033

[51] Int. Cl.[6] ..... B01F 15/06; B01F 7/20

[52] U.S. Cl. ..... 366/149; 366/314

[58] Field of Search ..... 366/7, 65, 66, 67, 144, 366/149, 194–196, 292, 309, 312–314; 165/109.1

[56] References Cited

U.S. PATENT DOCUMENTS

| | | | |
|---|---|---|---|
| 428,134 | 5/1890 | Price | 366/149 X |
| 531,824 | 1/1895 | Anderson | 165/109.1 X |
| 644,649 | 3/1900 | Walter | 165/109.1 |
| 722,366 | 3/1903 | Larsen | 165/109.1 |
| 733,471 | 7/1903 | Ellis et al. | 165/109.1 X |
| 737,292 | 8/1903 | Snow | 165/109.1 X |
| 2,831,418 | 4/1958 | Ponisch | 165/109.1 X |
| 3,771,594 | 11/1973 | Bornemann | 366/314 X |
| 4,361,405 | 11/1982 | Wedek et al. | 366/7 |
| 4,506,984 | 3/1985 | Strehlow | 366/65 |
| 4,655,605 | 4/1987 | Cipelletti | 366/312 |
| 4,918,665 | 4/1990 | Herfeld | 366/66 X |

FOREIGN PATENT DOCUMENTS

| | | | |
|---|---|---|---|
| 277999 | 9/1914 | Germany | 366/314 |
| 332924 | 2/1921 | Germany | 366/309 |
| 1956241 | 10/1971 | Germany . | |
| 1784357 | 6/1973 | Germany | 366/196 |
| 2911774 | 10/1980 | Germany . | |
| 411763 | 6/1934 | United Kingdom | 366/314 |
| 982506 | 2/1965 | United Kingdom | 366/149 |
| 8402679 | 7/1984 | WIPO . | |

*Primary Examiner*—Timothy F. Simone
*Assistant Examiner*—Charles Cooley
*Attorney, Agent, or Firm*—Robert W. Becker & Associates

[57] ABSTRACT

A cooling mixer for bulk material, especially plastic material, in powder and granular form has a cylindrical container with a bottom portion, the container having a container double wall with an intermediate space and at least one outlet opening at the bottom portion. A cover for closing the container is provided and has at least one feed opening. The cover has a cover double wall with an intermediate space. A rotating mixing device comprised of a hub and mixing paddles fixedly connected to the hub is concentrically connected to the container such that a vertical rotating axis of the mixing device coincides with the axis of the container. The coolant circuit containing a coolant that is circulated during operation of the cooling mixer within the intermediate spaces comprises connectors for connecting the coolant circuit to the container double wall and the cover double wall. The container has a diameter to height ratio of 4:1 to 8:1. The mixing paddles form an obtuse angle with the bottom portion in the direction of rotation of the mixing device for vertically deflecting the bulk material to be cooled.

8 Claims, 2 Drawing Sheets

METHOD FOR OPERATING COOLING MIXER FOR BULK MATERIAL IN POWDER AND GRANULAR FORM

This application is a continuation-in-part of application Ser. No. 07/894,723, filed Jun. 4, 1992, now abandoned.

BACKGROUND OF THE INVENTION

The present invention relates to a cooling mixer for bulk material, especially plastic material, in powder and granular form that comprises a cylindrical container with a container double wall and at least one outlet, a rotating mixing device comprised of a hub and mixing paddles fixedly connected to the hub, the mixing device concentrically connected to the container such that a vertical rotation axis of the mixing device coincides with the axis of the container, a coolant circuit containing a coolant that is circulated during operation of the cooling mixer within an intermediate space of the container double wall, and a cover for closing the container having at least one feed opening.

Cooling mixers of the aforementioned kind are especially employed for cooling plastic materials that have been prepared in heating mixers for preventing an undesired change of the properties, generated in the heating step, due to excessive temperatures.

Known cooling mixers having a mixing device rotating about a vertical rotating axis have container double walls whereby the container double walls during operation of the cooling mixer are cooled by a coolant, preferably water, and have a minimum height which corresponds approximately to the diameter of the container.

In order to be able to at least approximately use the entire mantle surface area of the cooling mixer for cooling the bulk material, the mixing device is operated at high circumferential speeds whereby, due to friction within the bulk material and between bulk material and mixer, the mixing chamber is provided with additional heat and whereby the inner area of the container bottom only insufficiently contributes to the cooling of the bulk material due to centrifugal forces acting on the bulk material.

It is furthermore known to provide coolable inserts to the interior of the container in order to increase the cooling surface area.

However, such inserts obstruct the forced circulation and mixing of the bulk material generated by the mixing device which results in a slower change of position of the particles of the bulk material and thus in an insufficient use of the cooling surfaces, especially of the inner container mantle surface. Also, due to the friction of the bulk material at the inserts, additional heat is generated within the mixing chamber.

According to German Patent 19 56 241 an annular double wall insert is provided which with its shape and arrangement within the container is adapted to the forced circulation of the bulk material and thus provides a uniform contact of the bulk material at the additional cooling surfaces; however, its contribution to the reduction of friction at the additional cooling surfaces and to the effective use of the other cooling surfaces is neglectable.

It is therefore an object of the present invention to provide a cooling mixer of the aforementioned kind such that a better use of the cooled surfaces due to a faster change of position of the particles to be mixed is achieved without generating a substantial amount of frictional heat within the mixing chamber.

BRIEF DESCRIPTION OF THE DRAWINGS

This object, and other objects and advantages of the present invention, will appear more clearly from the following specification in conjunction with accompanying drawings, in which.

SUMMARY OF THE INVENTION

Figure 1:
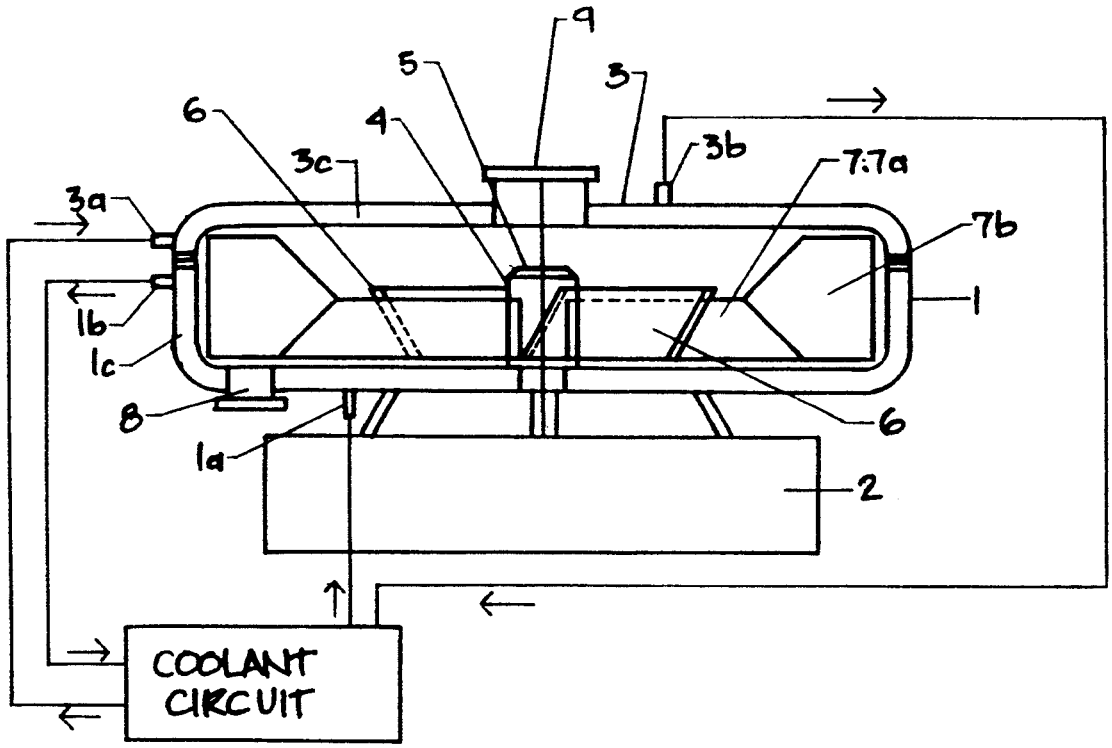
FIG. 1 shows a vertical cross-section of a cooling mixer.
Figure 2:
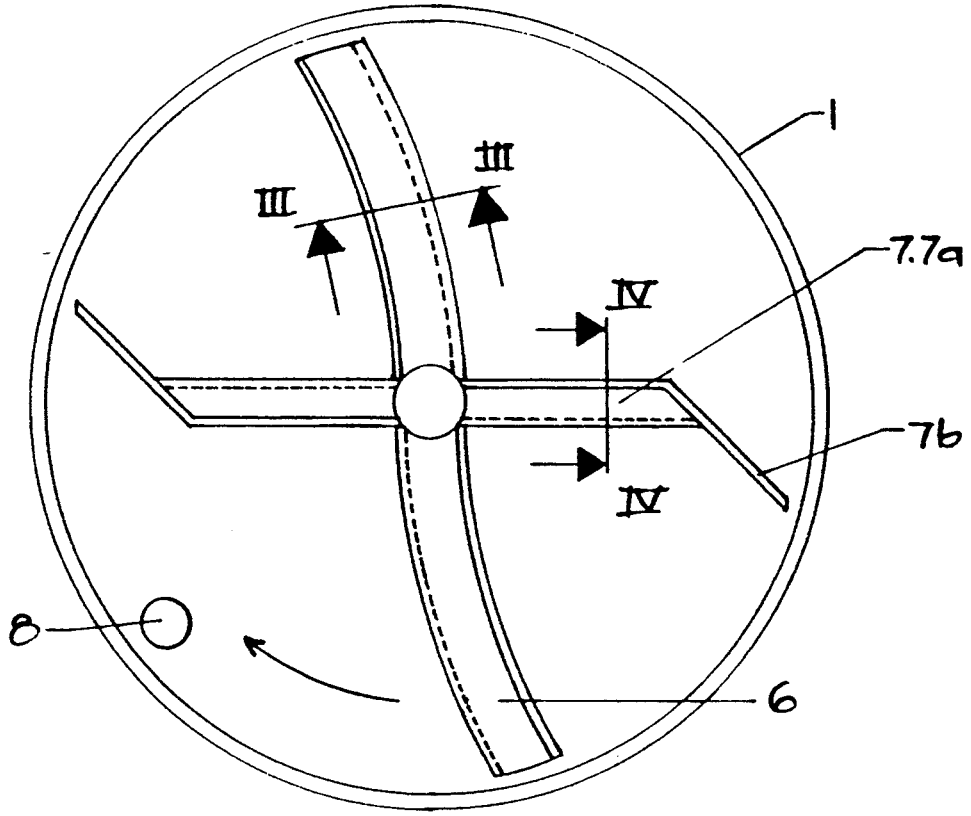
FIG. 2 is a plan view of the cooling mixer with the cover removed.
Figure 3:
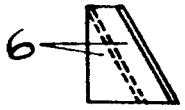
FIG. 3 shows a cross-section along the line III—III of the mixing paddle that conveys material in an outward direction.

The cooling mixer for bulk material in powder and granular form according to the present invention is primarily characterized by:

A cylindrical container with a bottom portion, the container having a container double wall with an intermediate space within the container double wall and at least one outlet opening at said bottom portion;

a cover for closing the container, the cover having at least one feed opening and a cover double wall with an intermediate space within the cover double wall;

a rotating mixing device comprised of a hub and mixing paddles fixedly connected to the hub, the mixing device concentrically connected to the container such that a vertical rotating axis of the mixing device coincides with the axis of the container;

a coolant circuit containing a coolant that is circulated during operating of the cooling mixer within the intermediate spaces of the container double wall and the cover double wall, the coolant circuit comprising connectors for connecting the coolant circuit to the container double wall and the cover double wall;

the container having a height that is smaller than its diameter; and the mixing paddles forming an obtuse angle with the bottom portion in a direction of rotation of the mixing device for vertically deflecting the bulk material to be cooled.

The advantages resulting from the present invention lie in an intensive mixing, unobstructed by inserts, of the bulk material, whereby the bulk material is forced into a primarily vertical circulation direction due to the mixing paddles and is thus cooled at the container cover in addition to the cooling effect resulting from the container bottom and the inner container mantle surface. Since coolable inserts are thus dispensable, cleaning of the mixer and the exchange of the worn mixing device are facilitated.

In a further embodiment of the present invention, the mixing paddles, when viewed in a top plan view, comprise a first set of at least one mixing paddle and a second set of at least one mixing paddle, with the mixing paddles of the first set extending essentially in a radial direction from the hub and having an end section that deviates substantially from the radial direction in the direction of rotation, and with the mixing paddles of the second set deviating from the radial direction counter to the direction of rotation, and with the mixing paddles of the first set and the mixing paddles of the second set being alternatingly arranged. Preferably, each mixing paddle of the first set has a stripper plate at its free end, the stripper plate extending into close vicinity of the container double wall and into close vicinity of the circumferential area of the cover. With these embodiments the cooling effect is improved due to a more intensive change of position of the particles of the bulk material in the radial direction.

In order to reduce the frictional heat generated within the mixing chamber, the method for operating the inventive cooling mixer comprises the step of rotating the mixing device at a low circumferential speed that generates a low, neglectable centrifugal force within the bulk material. It has been demonstrated by the invention that, in contrast to the long standing belief that for a good mixing effect a circumferential speed of 5.5 to 6.5 m/sec is necessary, a substantially reduced speed of approximately 1 to 3 m/sec does not reduce the cooling effect of the cooling surfaces on the bulk material.

Since in the inventive method the acceleration forces acting on the particles of the bulk material during the mixing process are very small, the bulk material is thus cooled in a very gentle manner. No fusion of the particles is observed, and no adhesion of particles to the mixing device takes place.

DESCRIPTION OF PREFERRED EMBODIMENTS

The present invention will now be described in detail with the aid of several specific embodiments utilizing FIGS. 1 through 4.

Figure 4:
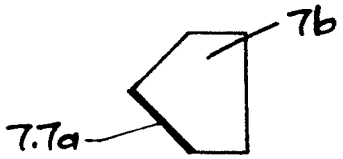
FIG. 4 shows a cross-section along the line IV—IV of the mixing paddle that conveys material in an inward direction.

The cylindrical container 1 of the cooling mixer, represented in a vertical cross-section in FIG. 1, is connected to a support frame 2 and is closed by a cover 3 which is embodied with a double wall with an inner and an outer wall having an intermediate space 3*c* for receiving a coolant and provided with coolant connectors 3*a*, 3*b*. The container 1 is provided with a double wall with an intermediate space 1*c* for receiving coolant, has coolant connectors 1*a*, 1*b* (the connected to a coolant circuit) and receives a concentrically arranged mixing device 4 which rotates about a vertical axis of rotation. The mixing paddles 6, 7 of the mixing device 4 are fixedly connected to the hub 5. The arrangement of the mixing paddles 6 and 7 may be taken from FIG. 2. The mixing paddles 6 are provided with a constant radius of curvature over their entire length, whereby this curvature is convex relative to the direction of movement of the bulk material. The mixing paddles 6 are connected to the hub 5 such that they are tilted about an angle of approximately 45° in the direction of rotation of the mixing device 4 (FIG. 3) so that the mixing paddles 6 force the bulk material in an upward direction in order to provide a uniform contact with the cover 3. The ratio of the height of the mixing paddles 6 relative to the height of the inner wall of the container 1 is between 0.5 and 0.9, at least for the central and the radially outwardly oriented portions of the paddles 6. The flat sheet sections 7*a* of the mixing paddles 7 are also connected to the hub 5 at an angle of 45° (FIG. 4). Their height relative to the height of the inner wall of the container 1 is preferably at least 0.3. Vertically extending stripper plates 7*b* are connected to the flat sheet sections 7*a* and extend into the immediate vicinity of the bottom portion, the mantle wall and the cover of the container and in a plan view form an angle of approximately 45° with the flat sheet sections 7*a* i.e., the ratio of the height of the stripper plates 7*b* corresponds substantially to the height of the inner wall of the container 1, that is the height ratio is substantially 1.

The cooling mixer of the present invention preferably has a diameter to height ratio of between 4:1 and 8:1.

For a uniform contact of the bulk material with the cooled surfaces, for example, for a mixer volume of approximately 1150 l, a ratio of the container diameter to its height of approximately 7 to 1 is desirable.

For cooling the bulk material the cooling mixer is filled via the feed opening 9 provided at the center of the cover 3 with bulk material to about 50 to 90% of the usable volume of the mixing chamber.

The coolant, for example, cooling water, is circulated through the intermediate spaces 1*c*, 3*c* of the container 1 and the cover 3. For mixing the bulk material the mixing device 4 is operated at a circumferential speed of between 1–3 m/sec. preferably at approximately 1 m/sec. With such a low circumferential speed, compared to prior art circumferential speeds, mixing of the bulk material takes place from a radially inward to a radially outward direction and vice versa and also in a vertical direction due to the design of the mixing paddles. After completion of the cooling process the bulk material is removed from the container via the outlet opening 8 provided at the bottom portion of the container within the area of the stripper plates 7*b*.

When the mixing chamber is only filled to about 50% of its usable volume, it is expedient to provide an increased number of mixing paddle pairs in order to provide a good mixing of the bulk material.

The present invention is, of course, in no way restricted to the specific disclosure of the specification and drawings, but also encompasses any modifications within the scope of the appended claims.

What I claim is:

1. A method for operating a cooling mixer for bulk material in powder and granular form, said cooling mixer comprising:

a) a cylindrical container with a bottom portion, a container double wall with an intermediate space between an inner and an outer wall of said container double wall, at least one outlet opening at said bottom portion, and a cover with at least one feed opening and a cover double wall with an intermediate space within said cover double wall;

b) a rotating mixing device having a hub and mixing paddles fixedly connected to said hub, said mixing device concentrically connected to said container such that a vertical rotating axis of said mixing device coincides with an axis of said container;

c) a coolant circuit containing a coolant that is circulated during operation of said cooling mixer within said intermediate spaces of said container double wall and said cover double wall, said coolant circuit comprising connectors for connecting said coolant circuit to said container double wall and said cover double wall;

said method comprising the steps of:

selecting a diameter to height ratio of 4:1 to 8:1 for said container such that said cover is positioned close to said bottom portion;

arranging said mixing paddles so as to form an obtuse angle with said bottom portion in a direction of rotation of said mixing device;

vertically upwardly deflecting the bulk material to be cooled with said mixing paddles so as to bring the bulk material into contact with said cover, positioned close to said bottom portion, for increasing the cooling effect on the bulk material; and rotating said mixing device at a low circumferential speed of 1–3 m/sec that generates a low, neglectable centrifugal force within the bulk material and reduces frictional heat within said container and the bulk material to be mixed without reducing the cooling effect of the cooling surfaces on the bulk material to be mixed.

2. A method according to claim 1, further comprising the step of:

arranging, when viewed from the top of said container, at least one first mixing paddle so as to extend essentially in a radial direction from said hub and at least one second mixing paddle so as to deviate from said radial direction counter to said direction of rotation, with said first mixing paddle having an end section that deviates substantially from said radial direction in said direction of rotation, to thereby achieve mixing of the bulk material from a radially inward direction to a radially outward direction and from a radially outward direction to a radially inward direction.

3. A method according to claim 2, further comprising the step of:

alternating said at least one first mixing paddle and said at least one second mixing paddle in a circumferential direction about said hub.

4. A method according to claim 2, further comprising the step of:

arranging a stripper plate at said end section of said at least one first mixing paddle, said stripper plate extending into close vicinity of said container double wall and into close vicinity of the circumferential area of said cover.

5. A method according to claim 4, further comprising the step of providing a ratio of a height of said stripper plate to a height of said inner wall of substantially 1.

6. A method according to claim 2, further comprising the step of providing a ratio of a height of said at least one second mixing paddle to a height of said inner wall of 0.5 to 0.9.

7. A method according to claim 2, wherein said at least one first mixing paddle has a central section, further comprising the step of providing a ratio of a height of said central section to a height of said inner wall of at least 0.3.

8. A method according to claim 1, wherein in the step of selecting said diameter to height ratio a ratio of to 7:1 is selected.

* * * * *